US006223646B1

(12) United States Patent
Carroll et al.

(10) Patent No.: US 6,223,646 B1
(45) Date of Patent: May 1, 2001

(54) CAMLESS VALVE ACTUATOR FOR COMPRESSION BRAKING AND NORMAL ENGINE OPERATIONS

(75) Inventors: Thomas S. Carroll, Peoria; Steven F. Meister, Chillicothe; Charles R. Miller, Metamora, all of IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/662,983

(22) Filed: Sep. 15, 2000

Related U.S. Application Data

(63) Continuation of application No. 09/231,107, filed on Jan. 14, 1999, now abandoned.

(51) Int. Cl.[7] ..... F01L 15/00
(52) U.S. Cl. ..... 91/189 A; 91/509; 91/512
(58) Field of Search ..... 91/189 A, 509, 91/512; 123/90.12, 90.14

(56) References Cited

U.S. PATENT DOCUMENTS 5,277,222 * 1/1994 Clarke ..... 137/495

* cited by examiner

*Primary Examiner*—Edward K. Look
*Assistant Examiner*—Thomas E. Lazo

(74) *Attorney, Agent, or Firm*—Eric M. Bram; Robert J. Hampsch

(57) ABSTRACT

An actuator for opening a poppet exhaust valve, which is closed by a spring and opens in normal operation against a relatively low pressure and which opens for compression braking against a relatively high pressure, is motivated in either event by the same hydraulic pressure. The actuator has a unitary central valve and piston element, which is coaxially directed toward the exhaust valve stem and has an area providing, when subjected to the pressure, a force sufficient to open the exhaust valve for normal operation but insufficient to open the exhaust valve during compression braking. The element extends through a relatively larger diameter annular piston which is slidably fitted about the element and within a bore receiving the annular piston. In normal operation, the element provides enough force to move from an unactuated position and open the exhaust valve, and initial movement of the element closes off passages in the element that admit the pressure to the piston which thus does not move. During compression braking, the force developed by the central element cannot move the element and the exhaust valve so that these passages admit pressure to the piston which provides sufficient force to move with the central element and open the exhaust valve. In either event, when the hydraulic pressure is subsequently reduced, the spring closes the exhaust valve and returns the actuator to its unactuated position. The actuator may be constructed to provide a smaller valve opening for braking than for normal operation.

10 Claims, 1 Drawing Sheet

CAMLESS VALVE ACTUATOR FOR COMPRESSION BRAKING AND NORMAL ENGINE OPERATIONS

This application is a continuation of Ser. No. 09/231,107, filed Jan. 14, 1999, now abandoned.

TECHNICAL FIELD

The present invention relates to an hydraulic operating mechanism for a poppet valve of an internal combustion engine providing compression braking. The invention is particularly related to such a mechanism useful with altered exhaust valve timing and lift for braking. The invention further relates to such a mechanism wherein a fluid actuated unitary piston and valve is movably mounted within another piston and has a separate actuator motion providing a differential reaction surface to increase valve actuation force.

BACKGROUND OF THE INVENTION

In the normal or power providing operation of reciprocating internal combustion engines, exhaust occurs near the end of the power stroke where the combustion gas pressure is relatively low after expansion of the combustion gases. For compression braking, however, fuel is not provided and exhaust of compressed air occurs near the end of the compression stroke; and, in order to dissipate as much of the energy of compression as possible, the cylinder pressure at exhaust valve opening is much higher than in normal operation. As a result and for a poppet exhaust valve utilizing a spring to close the valve, the force for valve opening during compression braking operation is, typically, 3 to 8 times that for normal operation.

For engines having poppet valves providing these operations, hydraulically motivated and electronically controlled actuation of the valves is desirable to provide flexibility in timing for optimized response, power, noise control, efficiency, and pollution control. Many arrangements dispensing with cams and providing such actuation are possible and a number are well-known. Since these arrangements are not a part of the present invention, it will only be mentioned that such arrangements to which the described embodiment of the present invention is applicable utilize a source of low hydraulic pressure and a source of high hydraulic pressure selectively connected to an actuator for closing and opening each poppet valve at varying and optimal times in relation to the position of the engine crankshaft. The hydraulic source selection is, typically, performed by electrically motivated valves and is electronically determined by a control system sensing variables such as crankshaft rotational speed and position, air inlet pressure, desired power in normal operation, and desired amount of compression braking. The control system provides, in relation to crankshaft position, the different exhaust poppet valve opening timing for normal operation and compression braking.

However, typical hydraulically motivated poppet valve actuators lack the force capability to open the exhaust valve during compression braking due to the above mentioned large required force. While actuators could be constructed to provide the necessary force, this would result in wasted energy for valve actuation in normal operation. It would, of course, be possible to construct such actuators providing the appropriate required different forces for normal operation and braking as selected by a control system of the nature described above. However, both the actuator and control system would still not be directly receptive to an actual need for greater force and would thus be somewhat inefficient. In any event, such an actuator and control system would necessarily be more complex, and the actuator could not directly replace existing camless hydraulic actuators lacking the force capability to open an exhaust valve during a compression braking cycle.

SUMMARY OF THE INVENTION

The present invention is particularly directed to a hydraulic actuator for a poppet exhaust valve where the actuator is electronically controlled to provide for variable valve timing during normal engine operation and for compression release during compression braking. An actuator of the present invention provides poppet valve opening force which is high for compression braking and low for energy conservation during normal engine operation. Motion or lack of motion of a low force providing element during the initial phase of exhaust poppet valve lift determines, respectively, that the actuator will provide relatively low or relatively high force to complete the lift.

An exhaust poppet valve actuator of the invention includes an inner piston which extends centrally through an annular outer piston of relatively larger area. The inner piston extends from one side of the annular piston and terminates in an end of relatively smaller area. To open the exhaust poppet valve, high pressure hydraulic fluid is provided to this inner piston end from which a passage communicates with the outer piston side disposed toward the inner piston end. In normal operation, the force provided by the inner piston is sufficient to open the poppet valve, and this piston moves so as to open the poppet valve and block the passage communicating with the outer piston. During compression braking, however, the required force is greater so that the inner piston does not move initially and the high pressure fluid passes through the inner piston passage and acts on the outer piston which has a large enough surface area to provide enough force to open the poppet valve.

More specifically, the described actuator embodiment is for opening a poppet exhaust valve, which is closed by a spring and opens in normal operation against a relatively low pressure and which opens for braking against a relatively high pressure. The actuator is characterized by being motivated by the same hydraulic pressure in both modes of operation. The inner piston, with its fluid passage, is of unitary construction and is coaxial with the stem of the exhaust valve. The inner piston also extends from the outer piston at the side thereof opposite the inner piston end subjected to such pressure, and this opposite end bears a collar or annular projection for engagement with the corresponding side of the outer piston. The outer piston is slidably fitted internally to the inner piston and slidably fitted externally within a bore of a actuator body receiving the outer piston. In normal operation, the inner piston moves from its unactuated position and opens the exhaust valve. For braking, the force developed by the inner piston cannot move it and the exhaust valve, but the hydraulic pressure admitted through the inner piston passages to the outer piston moves it from its unactuated position to engage the inner piston collar with sufficient force to move the inner piston and open the exhaust valve.

In either mode of operation and when the hydraulic pressure is subsequently and sufficiently reduced, the exhaust valve spring closes the exhaust valve; and the stem thereof urges the inner piston toward its unactuated position with the collar engaging the outer piston and carrying the outer piston to its unactuated position if it has moved therefrom for compression braking operation.

In relation to normal operation, a lesser exhaust poppet valve movement may be used for braking operation as sufficient to release the compressed air and as necessary to limit the opening of the exhaust valve so that it does not contact an associated piston. Accordingly and to reduce valve operating energy, the actuator body may be constructed so as to engage the outer piston and stop the movement thereof from its unactuated position after such lesser movement, while the inner piston remains free to move the full poppet valve opening distance corresponding to normal engine operation.

DETAILED DESCRIPTION OF THE INVENTION

Figure 1:
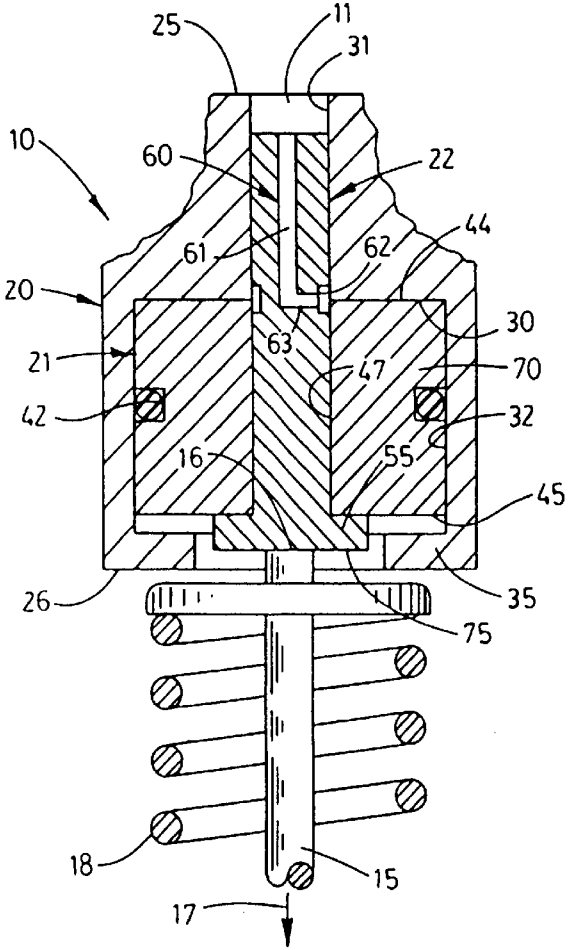
FIG. 1 is a an axial section of a camless poppet valve actuator embodying the present invention to provide compression braking and normal engine operation. The actuator is depicted together with associated and fragmentarily represented poppet valve elements which are a representative operating environment for the actuator, and the elements of the actuator are depicted in unactuated positions corresponding to a closed position of the poppet valve.

FIG. 1 shows a camless, hydraulic, poppet valve actuator indicated generally by the numeral 10 and embodying the present invention to provide compression braking and normal engine operation. The actuator has a connection 11 for pressurized fluid; and the elements of the depicted actuator are of generally cylindrical construction and are coaxially related to a stem 15 of a poppet valve assembly, the actuator being motivated by a such fluid to provide predetermined linear movements of such an assembly which may be of any suitable construction and is thus conventionally and fragmentarily represented. The poppet valve assembly and its operation are presented herein as applicable to the exhaust of a four-cycle, compression ignition internal combustion engine although the present invention is not limited to this application.

When connection 11 is provided with a relatively higher and predetermined fluid pressure, actuator 10 engages end 16 of stem 15; and elements of the actuator and the poppet valve move in a direction indicated by arrow 17 to camlessly open the poppet valve by overcoming the resilient force of a valve spring 18. When connection 11 is subsequently provided with a relatively lower and also predetermined fluid pressure, spring 18 closes the poppet valve and returns the depicted poppet valve and actuator elements to their relative positions shown in FIG. 1 from which these elements moved in direction 17 to open the poppet valve.

These fluid pressures are hydraulic and provided by lubricating oil or diesel fuel. For example, the higher pressure may be 1500 to 3000 psi or more and the lower pressure may be 200 to 400 psi. Typically, a selected one of these pressures is provided by an electrically motivated and electronically controlled valve arrangement to determine the opening and closing times of an exhaust poppet valve. In relation to the crankshaft and piston position of an engine having an actuator, such as actuator 10, embodying the present invention, these times will be , as before mentioned, different for normal operation and for compression braking and, in either case, may be determined in any suitable manner by a controller receptive to control signals representing variables such as crankshaft rotational speed, crankshaft position, air inlet pressure, desired power in normal operation, and desired amount of compression braking.

However, for the purposes of the present invention, the only relevant aspect of the hydraulic and control functions described in the preceding paragraph is that, as before mentioned, the force required to initially open an exhaust valve during compression braking is many times such force required in normal operation, camless actuator 10 providing the required force in either case with the control and hydraulic arrangements utilized selecting only the timing without regard to the force required at the time of valve opening.

With reference to FIG. 1, actuator 10 is seen to include a body 20, an annular piston 21, and a cylindrical or central piston 22, the pistons being coaxially related to each other and to poppet valve stem 15. The actuator has an end 25 at fluid connection 11 and has an opposite end 26 at the valve stem.

Body 20 has a planar, annular internal surface 30 having an inner diameter and an outer diameter. The body has a first, smaller bore 31 of a diameter equal to the inner diameter and has a second, larger bore 32 of a diameter equal to the outer diameter. These bores and the surface are coaxially related; and the outer diameter is depicted in the Figures as about four times the inner diameter, a ratio appropriate for the application of the subject invention to compression braking of an internal combustion engine. Bore 31 extends from surface 30 toward actuator end 25 and there serves as connection 11 for pressured fluid. Bore 32 extends oppositely of surface 30 toward actuator end 26, and it is apparent that the surface joins the bores 31 and 32. At actuator end 26, body 20 bears a ring 35 which extends somewhat radially inwardly of bore 32 and serves as a stop for annular piston 21 which is received in the larger bore for movement axially thereof. Ring 35 is represented as unitarily constructed with the rest of body 20, but may be separate and fixed thereto in any suitable manner.

Annular piston 21 has an exterior surface 40 which is slidably fitted in larger bore 32 and is depicted as bearing an annular groove 42 receiving an O-ring for sealing of fluid provided from connection 11. The annular piston has an end 44 disposed toward body surface 30. This end is planar so as to conform to the body surface and is sometimes referred to in the claims as an "annular pressurizable end". Opposite its end 44, annular piston 21 has an end 45 which is sometimes referred to in the claims as an "annular actuating end" and is disposed oppositely of this piston from body surface 30. This piston has a cylindrical interior surface 47 of a diameter equal to the inner diameter of body surface 30 and, thus, equal to the diameter of smaller body bore 31.

Cylindrical piston 22 has a diameter substantially equal to the diameter of smaller body bore 30 and is slidably received in this smaller bore and in surface 47 of annular piston 21. The cylindrical piston is represented as being fitted in fluid tight relation to bore 31 and surface 47, but O-rings could be used as in annular piston groove 42.

It is apparent that cylindrical piston 22 is disposed centrally of annular piston 21, and that the cylindrical piston extends axially oppositely from the annular piston. One end portion 50 of the cylindrical piston is extended from the annular piston beyond its end 45 for connection to a device actuated by actuator 10, as by engagement of poppet valve stem end 16 by an end 51 of the cylindrical piston, this end being sometimes referred to in the claims as a "central actuating end" to distinguish it from the annular actuating end of piston 21. The other end portion 52 of the cylindrical piston is disposed in the smaller body bore 31 and terminates therein at an end surface 53 sometimes referred to in the claims as a "central pressurizable end".

End portion 50 of cylindrical piston 22 bears a collar or annular projection 55 extending radially outwardly from the rest of this piston to a diameter substantially greater than the diameter of annular piston surface 47 but less than the interior diameter of body ring 35 and thus less than the diameter of larger body bore 32 and annular piston exterior surface 40. Annular projection 55 circumscribes piston 22 at its actuating end 51 and, preferably, is unitarially constructed with the rest of this piston. It is evident that the outer diameter of projection 55 is such that this projection is disposed for engagement by annular piston end 45 when the annular piston moves in actuation direction 17 toward the projection and that the projection and the cylindrical piston can move axially in this direction from the annular piston and through ring 35.

Cylindrical piston 22 has, in its portion 52, fluid passages indicated generally by numeral 60 and moving with this piston to function as a valve for pressurized fluid provided at connection 11. These passages include a bore 61 opening at piston end 53 and extending axially and centrally of the piston to an annular groove 62 opening peripherally of the piston and connected to bore 61 by a radial bore 63.

The forces, movements, and relative axial positions of the elements of actuator 10 that provide its operation in accordance with the present invention and will now be described.

Figure 3:
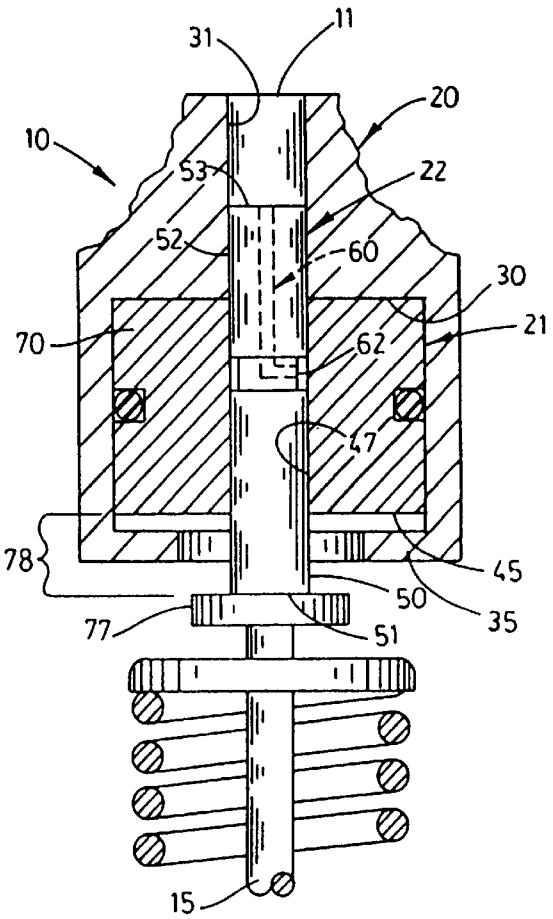
FIG. 3 is a section of the actuator similar to FIG. 1, but with the actuator and poppet valve elements in a relation corresponding to a fully open poppet valve position for normal engine operation and with the inner piston not sectioned.
Figure 2:
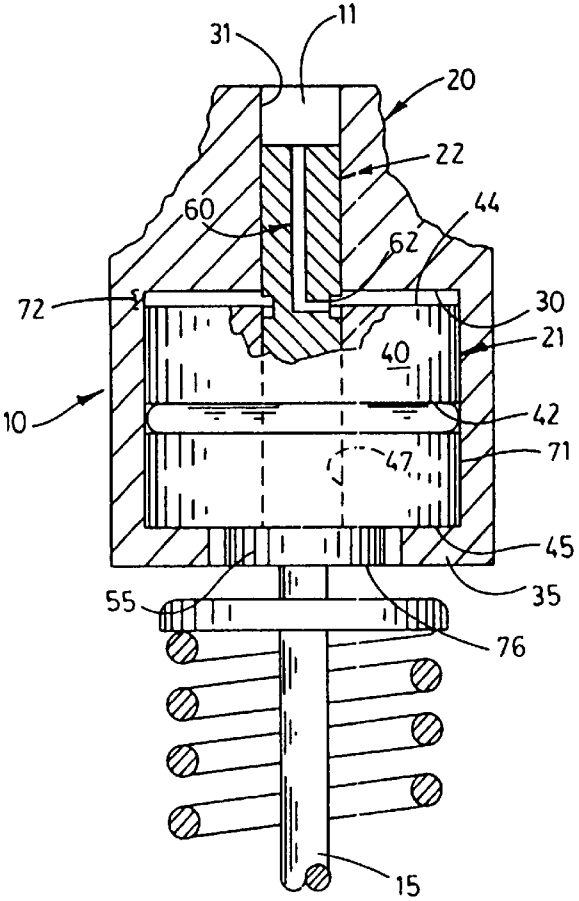
FIG. 2 is a section of the actuator similar to FIG. 1, but with the actuator and poppet valve elements in a relation corresponding to a partially open poppet valve position for compression braking and with inner and outer pistons of the actuator partially sectioned.

Annular piston 21 is moveable between an unactuated position 70, shown in FIGS. 1 and 3, wherein its pressurizable end 44 is juxtapositioned to body surface 30, and an actuated position 71, shown in FIG. 2 wherein this end is spaced a predetermined distance, indicated by numeral 72, in direction 17 from the surface 30.

Cylindrical piston 22 is moveable between an unactuated position 75, shown in FIG. 1, toward fluid connection 11, and actuated positions 76 and 77, respectively shown in FIGS. 2 and 3, away from said connection in direction 17. Position 76 is spaced the distance 72 from the unactuated position, and position 77 is spaced from the unactuated position the distance indicated in FIG. 3 by numeral 78. This distance is determined in any suitable manner, which is not involved in the present invention, as by the force provided by spring 18 equaling the hydraulic force on central piston end 53.

Distance 78 corresponds to a "predetermined first actuating movement" referred to in the claims and occurring when the predetermined fluid pressure from connection 11 acts on surface 53 of cylindrical piston 22 so that actuator 10 provides a relatively lower first force moving the exhaust poppet valve assembly having stem 15. This force corresponds to the fluid pressure acting on the area of surface 53 which is smaller than the larger area of end 44 of annular piston 21. It is apparent that the actuator can provide a relatively larger second force corresponding to the fluid pressure acting on this larger area and provided by the annular piston which has an outer diameter corresponding to such larger area and an inner diameter corresponding to such smaller area.

These diameters are selected so that such a first force is sufficient to move cylindrical piston 21 and such poppet valve assembly during normal internal combustion engine operation when this assembly requires such lower force. This condition is represented in FIG. 3 where the cylindrical piston and the poppet valve stem 15 have moved the distance 78. These diameters are also selected so that this first force is, by itself, insufficient to move this piston and the poppet valve assembly when movement of the assembly requires the higher force necessary during compression braking. These diameters are further selected so that such second force is at least equal to such higher force less such first force.

It will be evident from FIG. 2, that annular projection 55 about end 51 of cylindrical piston 22, when engaged by end 45 of annular piston 21 and when engaging valve stem end 16, serves to apply this first force and this second force to the poppet valve assembly. It is apparent that this engagement occurs because the projection is disposed for contact by annular piston 21 when the cylindrical piston and the annular piston are each in their respective unactuated positions 76 and 70 and movement of the annular piston from its unactuated position toward its actuated position 71 carries the cylindrical piston from its unactuated position toward its actuated position 76. That is, the annular projection from the cylindrical piston having a larger diameter than the inner diameter of the annular piston results in the annular piston engaging the cylindrical piston and transferring to the cylindrical piston a force provided by fluid pressure from connection 11 acting on the annular piston end 44.

Ring 35 is spaced oppositely of annular piston 21 from bore 31 a distance such that, when the predetermined fluid pressure acts on this piston, the piston engages the ring when the piston moves the actuating distance 72 which is shorter than the actuating distance 78 of cylindrical piston 22. That is, ring 35 is spaced axially from body surface 30 a distance, which is equal to the length of the annular piston plus the distance 72 between the unactuated position 70 and the actuated position 71 of the annular piston, to stop the movement of the annular piston from position 70 to position 71. However, as is apparent from FIG. 3, the diameter of annular projection 55 on the cylindrical piston is less than the internal diameter of ring 35 so that the cylindrical piston is moveable axially from the annular piston in direction 17 when the annular piston is in its unactuated position.

It is evident from FIG. 1 that annular groove 62 of fluid passages 60, which are in cylindrical piston 22 and thus move with it to function as a valve for pressurized fluid provided at connection 11, opens peripherally of cylindrical piston 22. It is further evident that the groove is disposed axially along the cylindrical piston so that, when the cylindrical piston is in the unactuated position 75, the groove is positioned at body surface 30 for fluid flow outlet between this surface and end 44 of annular piston 21. It is evident from FIG. 3 that the axial position of groove 62 along the cylindrical piston is also such that this groove is positioned within cylindrical interior surface 47 of the annular piston for fluid flow blocking when the annular piston is in its unactuated position 70 and the cylindrical piston moves somewhat towards its actuated position 77 from its unactuated position 75.

Therefore, the valve passages 60 provide pressurized fluid from connection 11 through bores 61 and 63 and groove 62 to surface 44 of annular piston 21 to provide the above-described second force when the above-described first force provided by cylindrical piston 22 is insufficient to move it because the poppet valve assembly having stem 15 requires the higher force necessary during compression braking. As a result, the combined first force and second force are developed for poppet valve opening as set forth above.

However, when such first force is sufficient for poppet valve opening, as during normal engine operation, cylindrical piston 22 moves from its unactuated position 75 within surface 47 of annular piston 21 blocking fluid pressure from annular piston and resulting in the second force not being developed.

From the above, it is evident that the valve passages 60 have a first position, which corresponds to the unactuated position 75 of cylindrical piston 22, for admitting pressurized fluid to larger bore 32 at body surface 30 where the larger bore joins smaller bore 31. It is also evident that the valve passages has a second position, which corresponds to any position of the cylindrical piston beyond its position 76 toward its position 77, for blocking such fluid to the larger bore.

It is apparent that valve passages 60 are, in effect, connected to cylindrical piston 22 so that the passages are in such first position when this piston is in a disposition where it is fully received in the smaller bore to the extent possible. This disposition occurs when the elements of actuator 10 are positioned as depicted in FIG. 1 where annular piston 21 is juxtapositioned against body surface 30 and annular projection 55 is against annular piston surface 45. It is further apparent that the valve passages are connected to the cylindrical piston so that the passages are in such second position when the cylindrical piston moves from this disposition as shown in FIG. 3.

When the hydraulic pressure provided at connection 11 is reduced, as described above, to close a poppet valve associated with actuator 10, either in normal operation or during compression braking, spring 18 closes the exhaust valve and stem 15 returns central piston 22 to its unactuated position 75 with annular projection 55 carrying annular piston 21 to its unactuated position 70 if the annular piston has moved therefrom.

Although the present invention has been described in connection with what is conceived to be a practical and preferred embodiment, it is recognized that departures may be made therefrom within the scope of the invention. which is not limited to the illustrative details disclosed.

What is claimed is:

1. An actuator motivated by a fluid at a predetermined pressure for movement of an object, said movement sometimes requiring a relatively lower predetermined force and at other times requiring a relatively higher predetermined force; and the actuator comprising:

a first piston for subjection to said fluid, said first piston having an area such that said pressure provides a first force at least equal to said lower force and less than said higher force;

a second piston for subjection to said fluid, said second piston having an area such that said pressure provides a second force at least equal to said higher force less said first force;

means connected to said first piston and to said second piston for applying said first force and said second force to said object so that said first force moves said first piston and said object when said object requires said lower force, and said first piston and said object cannot move when said object requires said higher force;

means for providing said fluid to said first piston; and valve means for providing said fluid to said second piston to provide said second force when said first piston cannot move because said object requires said higher force so that said first force and said second force move said object, and for blocking said fluid from said second piston when said first force moves said first piston and said object so that said second force is not developed.

2. The actuator of claim 1 wherein said second piston is annular, and said first piston is cylindrical and is disposed centrally of said second piston.

3. The actuator of claim 1 wherein said valve means includes a passage disposed in said first piston and moving with said first piston.

4. The actuator of claim 1 wherein:

said second piston is annular, and said first piston is cylindrical and is disposed centrally of said second piston; and said valve means includes a passage disposed in said first piston and moving with said first piston.

5. An actuator for motivation by a pressurized fluid to provide a predetermined linear movement of an object, the actuator comprising:

a body defining an annular internal surface having an inner diameter and an outer diameter, a first bore of said inner diameter, the first bore extending coaxially from said surface to a connection for said fluid, a second bore of said outer diameter, the second bore extending coaxially from said surface and oppositely of the first bore;

an annular piston having a length greater than said movement, having a cylindrical exterior surface slidably received in the second bore, having a cylindrical interior surface of said inner diameter, having an annular pressurizable end conforming to said annular surface of the body and disposed toward said annular surface of the body, having an annular actuating end opposite said pressurizable end, and being moveable between an unactuated position wherein said annular pressurizable end is juxtapositioned to said annular internal surface of the body, and an actuated position wherein said annular pressurizable end is spaced a predetermined distance from said annular internal surface of the body;

a cylindrical piston slidably received in the first bore and in said cylindrical interior surface of the annular piston, the cylindrical piston being moveable between an unactuated position toward said connection for said fluid and an actuated position away from said connection for said fluid, extending into the first bore a distance greater than said movement when the cylindrical piston is in the unactuated position, having a central pressurizable end disposed in said first bore, extending through the annular piston and from said annular actuating end of the annular piston, having a central actuating end disposed axially beyond said annular actuating end, and defining a passage for said fluid, the passage having one end opening at said central pressurizable end, and an opposite end opening peripherally of the cylindrical piston and disposed axially along the cylindrical piston so as to be positioned at said annular internal surface of the body for fluid flow outlet when the cylindrical piston is in the unactuated position, and positioned within said cylindrical interior surface of the annular piston for fluid flow blocking when the annular piston is in the unactuated position and the cylindrical piston moves toward the actuated position from the unactuated position; and a projection fixed to and extending radially from the central actuating end of the cylindrical piston, the projection being disposed for engagement with said annular actuating end of the annular piston when the cylindrical piston and the annular piston are each in the unactuated position so that movement of the annular piston from the unactuated position toward the actuated position carries the cylindrical piston from the unactuated position toward the actuated position.

6. The actuator of claim 5 wherein the cylindrical piston and the projection are unitarially constructed, and wherein the projection circumscribes the cylindrical piston at said actuating end and has an outer diameter greater than said inner diameter and less than said outer diameter.

7. The actuator of claim 5 further comprising a stop for the annular piston, the stop being disposed on the body, extending radially inwardly from the second bore, and being spaced axially from said annular internal surface a distance equal to the length of the annular piston plus a predetermined distance between the unactuated position of the annular piston and the actuated position of the annular piston.

8. The actuator of claim 5 wherein:

the actuator further comprises a ring fixed to thebody and extended radially inwardly from the second bore, the ring having an internal diameter less than said outer diameter of said annular surface, and being spaced axially from said annular internal surface a distance greater than the length of the annular piston so as stop the movement of the annular piston from the unactuated position at the actuated position; and the projection circumscribes the cylindrical piston at said actuating end and has an outer diameter greater than said inner diameter of said internal annular surface for engagement of the annular piston with the projection when the annular piston moves from the unactuated position, said outer diameter being less than said internal diameter of the ring so that the cylindrical piston is moveable axially from the annular piston when the annular piston is in the unactuated position.

9. An actuator providing a first force corresponding to a predetermined fluid pressure acting on a smaller area, providing a second force corresponding to said pressure acting on a larger area, and comprising:

an annular piston having an outer diameter corresponding to said larger area and an inner diameter corresponding to said smaller area;

a cylindrical piston having a diameter substantially equal to said inner diameter, extending through and oppositely from the annular piston, having one end portion for engagement of an actuated device, and having an opposite end portion;

a body having a first bore disposed at one side of the annular piston and slidably receiving said opposite end portion of the cylindrical piston, a connection providing fluid at said pressure to the first bore at said opposite end portion, and a second bore extending from a junction with the first bore and slidably receiving the annular piston; and a valve having a first position for admitting said fluid to said second bore at said junction with the first bore, and a second position for blocking said fluid to said second bore at said junction, the valve being connected to the cylindrical piston so that when the cylindrical piston is in a disposition wherein the cylindrical piston is fully received axially in the first bore, the valve is in said first position, and when the cylindrical piston moves from said disposition, the valve is in the second position, whereby:

when the predetermined fluid pressure acts on said opposite end of the cylindrical piston and the first force does not move an actuated device connected to said one end of the cylindrical piston, the valve provides the predetermined pressure to the annular piston so that the pistons provide the second force, and when the predetermined fluid pressure acts on said opposite end of the cylindrical piston and the first force does move an actuated device connected to said one end of the cylindrical piston, the valve blocks the predetermined pressure to the annular piston.

10. The actuator of claim 9 wherein:

the cylindrical piston has a predetermined first actuating movement when the predetermined fluid pressure acts on said opposite end of the cylindrical piston and the first force moves an actuated device connected to said one end of the cylindrical piston;

said opposite end of the cylindrical piston bears an annulus having a larger diameter than said inner diameter for engagement by the annular piston to transfer to the cylindrical piston a force provided by said predetermined pressure acting on the annular piston; and the body bears a stop extending inwardly of the second bore and spaced oppositely of the annular piston from the first bore a distance such that, when the predetermined fluid pressure acts on the annular piston, the annular piston engages the stop when the annular piston makes a predetermined second actuating movement shorter than said first actuating movement.

* * * * *